US011634902B2

(12) United States Patent
Jiang

(10) Patent No.: US 11,634,902 B2
(45) Date of Patent: Apr. 25, 2023

(54) ASSEMBLED STRUCTURE SYSTEM AND APPLICATIONS THEREOF

(71) Applicant: Yucheng Jiang, Xiamen (CN)

(72) Inventor: Yucheng Jiang, Xiamen (CN)

( * ) Notice: Subject to any disclaimer, the term of this patent is extended or adjusted under 35 U.S.C. 154(b) by 0 days.

(21) Appl. No.: 17/293,975

(22) PCT Filed: Sep. 20, 2019

(86) PCT No.: PCT/CN2019/106844
§ 371 (c)(1),
(2) Date: May 14, 2021

(87) PCT Pub. No.: WO2020/098387
PCT Pub. Date: May 22, 2020

(65) Prior Publication Data

US 2022/0010544 A1 Jan. 13, 2022

(30) Foreign Application Priority Data

Nov. 15, 2018 (CN) ..... 201811360829.7

(51) Int. Cl.
*E04B 1/38* (2006.01)
*E04B 1/41* (2006.01)

(52) U.S. Cl.
CPC ..... *E04B 1/40* (2013.01); *E04B 2001/405* (2013.01)

(58) Field of Classification Search
CPC ..... E04B 1/41; E04B 2001/405; E04B 1/40
USPC ..... 52/698
See application file for complete search history.

(56) References Cited

U.S. PATENT DOCUMENTS 4,000,591 A * 1/1977 Courtois ..... E04G 21/142 52/707
4,018,470 A * 4/1977 Tye ..... B66C 1/666 52/707
7,451,580 B2 * 11/2008 Kelly ..... E04C 5/20 D25/199
8,397,464 B2 * 3/2013 Lin ..... E04B 1/4157 52/701

(Continued)

FOREIGN PATENT DOCUMENTS

CA 2286745 A1 4/2001
CN 102829051 A 12/2012

(Continued)

*Primary Examiner* — Basil S Katcheves
(74) *Attorney, Agent, or Firm* — Bayramoglu Law Offices LLC

(57) ABSTRACT

An assembled structure system includes a prefabricated member, a fastener and a locking member. The prefabricated member is provided with at least one cavity, and the fastener is assembled in the at least one cavity. At least one fastener is assembled in each cavity. The cavity includes an upper end surface, a lower end surface, a left end surface and a right end surface. The left end surface or the right end surface includes a vertical surface perpendicularly connected to the upper end surface and an inclined surface connected to the vertical surface. A connection angle between the vertical surface and the outer side of the inclined surface forms an obtuse angle. The inclined surface is connected to the lower end surface. The fastener includes a fixed surface, two side surfaces and a bottom surface. The fixed surface, the two side surfaces and the bottom surface are hingedly connected.

20 Claims, 11 Drawing Sheets

(56) References Cited

U.S. PATENT DOCUMENTS

| | | | | |
|---|---|---|---|---|
| 8,544,814 | B2 * | 10/2013 | Diaz | E04B 1/4157 249/207 |
| 9,151,038 | B2 * | 10/2015 | Zimmerman | E04B 1/41 |
| 9,222,251 | B2 * | 12/2015 | Espinosa | E04B 1/4171 |
| 9,631,392 | B2 * | 4/2017 | Bergman | E04H 12/2261 |
| 2011/0041450 | A1 * | 2/2011 | Espinosa | E04C 5/125 52/698 |
| 2014/0182236 | A1 * | 7/2014 | Doupe | E04F 15/02044 52/698 |
| 2021/0189716 | A1 * | 6/2021 | Brekke | E04B 1/40 |
| 2021/0246651 | A1 * | 8/2021 | Doupe | E04B 1/003 |

FOREIGN PATENT DOCUMENTS

| | | | |
|---|---|---|---|
| CN | 109235661 | A | 1/2019 |
| CN | 209129165 | U | 7/2019 |
| DE | 4143352 | C2 | 7/1995 |
| WO | 02101690 | A1 | 12/2002 |

* cited by examiner

ASSEMBLED STRUCTURE SYSTEM AND APPLICATIONS THEREOF

CROSS REFERENCE TO THE RELATED APPLICATIONS

This application is the national phase entry of International Application No. PCT/CN2019/106844, filed on Sep. 20, 2019, which is based upon and claims priority to Chinese Patent Application No. 201811360829.7, filed on Nov. 15, 2018, the entire contents of which are incorporated herein by reference.

TECHNICAL FIELD

The present invention relates to an assembled structure system, and more particularly, to an assembled structure system with a built-in cavity configuration and applications thereof.

BACKGROUND

In prior composite structure systems, prefabricated buildings generally use reinforced concrete members for assembly combination, and generally use sleeve grouting to assemble and then cast in situ. Steel frame structural buildings generally use bolted connection and/or welding, and their process is relatively complicated. The existing three-in-one connector for furniture articles is generally used for a slab-type structure, and bears little force.

SUMMARY

In the prior composite structures, the assembly generally has shortcomings such as troublesome mounting and insufficient firmness and so on.

An objective of the present invention is to provide an assembled structure system and applications thereof to simplify assembled structures such as buildings, furniture and the like, so that the assembly is easier and more convenient with higher accuracy and faster speed.

In order the achieve the above objective, the present invention adopts the following technical solutions. An assembled structure system includes a prefabricated member, a fastener and a locking member. The prefabricated member is provided with at least one cavity, and the fastener is assembled in the at least one cavity. At least one fastener is assembled in each cavity. The cavity includes an upper end surface, a lower end surface, a left end surface and a right end surface. The upper end surface is provided with a fastener through hole or a locking member through hole, wherein the fastener passes through the fastener through hole, and the locking member passes the locking member through hole. The left end surface or the right end surface includes a vertical surface perpendicularly connected to the upper end surface and an inclined surface connected to the vertical surface. A connection angle between the vertical surface and the outer side of the inclined surface forms an obtuse angle. The inclined surface of each of the left end surface and the right end surface is connected to the lower end surface. The upper end surface is located at an upper end or a lower end of the vertical surface, or located between the upper end and the lower end of the vertical surface. The fastener includes a fixed surface, two side surfaces and a bottom surface. The fixed surface is provided with at least one locking hole or through hole. The bottom surface is a curved surface, an arc surface, a fold-line surface or a trapezoidal surface. The total width of the bottom surface is greater than or equal to the width of the fixed surface and greater than or equal to the width of the lower end surface. Optionally, the bottom surface is formed by two inclined bottom surfaces that are folded inwardly. The total width of the two inclined bottom surfaces is greater than or equal to the width of the fixed surface and greater than or equal to the width of the lower end surface. The height of the fastener is higher than the height of the inclined surface. The fastener has a flexibleness in connection portions between the fixed surface and the two side surfaces, connection portions between the two side surfaces and the bottom surface, and a connection portion between the bottom surfaces. Optionally, the fixed surface and the two side surfaces are hingedly connected, the two side surfaces and the bottom surface are hingedly connected, and the bottom surfaces are hingedly connected.

Preferably, the connection angle between the vertical surface and the outer side of the inclined surface is 120°-175°.

Further, a block is disposed above the bottom surface.

Further, a fixed member is disposed under the fixed surface, and the fixed member is provided with at least one threaded hole. The threaded hole is located under and corresponds to the locking hole or through hole.

Further, the fixed member is an angle connector, and each of both end surfaces of the angle connector is provided with the at least one threaded hole.

Further, the locking member is a bolt or a screw.

Further, the left end surface and the right end surface are symmetrical to each other, and the two side surfaces of the fastener are symmetrical to each other.

Further, the two inclined bottom surfaces are separated from or connected to each other.

In another aspect of the present invention, an application of the assembled structure system in a profile is provided.

Further, the profile is applied to a furniture or industrial frameworks.

Further, the furniture includes a cabinet, a wardrobe, a bookcase, a locker, a clapboard, a guardrail, a table, a chair, a door or a window.

In yet another aspect of the present invention, an application of the assembled structure system in a building or an appendage construction of the building is provided.

Further, the building or the appendage of the building includes a column, a beam, a shear wall, an external wall panel, an internal wall panel, a floor slab, a stair, a balcony slab, a bridge or a bridge pier.

Further, a channel steel or a channel steel framework is disposed in the prefabricated member, and the cavity is located in the channel steel or connected to the channel steel framework.

Further, a locking member mounting preformed hole or a fastener mounting preformed hole is disposed at the outer side of the cavity of the prefabricated member.

Further, the column is a wing-shaped column, and the beam is a wing-shaped beam.

After employing the above technical solutions, the present invention has the following advantageous effect. The assembled structure system of the present invention has advantages that the assembly is easy, convenient, fast and firm, and has high accuracy.

REFERENCE NUMBER OF MAIN COMPONENTS

1. fastener, 11. fixed surface, 111. through hole or locking hole, 12. bottom surface, 13. left side surface, 14. right side surface, 15. block, 2. cavity, 21. upper end surface, 211. locking member through hole, 212. locking member mounting preformed hole or fastener mounting preformed hole, 213. fastener through hole, 22. lower end surface, 23. left end surface, 231. vertical surface, 232. inclined surface, 24. right end surface, 3. locking member, 30. wing-shaped beam, 31. wing-shaped column, 32. prefabricated wall, 33. prefabricated floor slab, 34. in-situ casting beam-column joint, 35. steel structure framework, 351. steel plate, 4. prefabricated member, 5. profile, 51. fixed member, 511. threaded hole.

DETAILED DESCRIPTION OF THE EMBODIMENTS

In order to make objectives, technical solutions and advantages of the present invention clearer, the present invention will be further explained in detail in conjunction with the figures and the exemplary embodiments.

Figure 1:
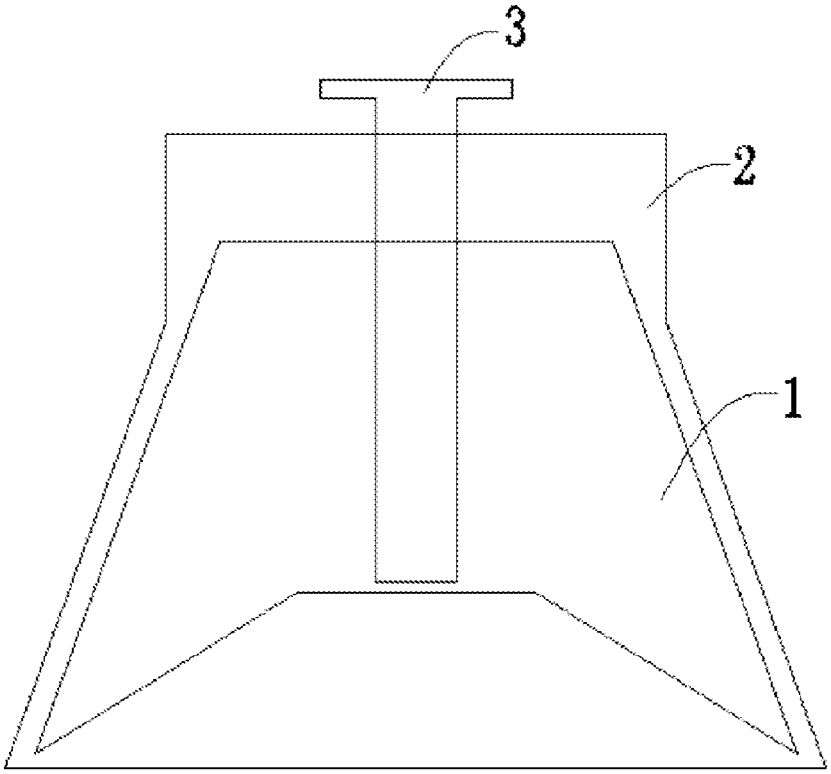
FIG. 1 is a first cross-sectional schematic diagram of an assembled structure system according to the present invention.
Figure 2:
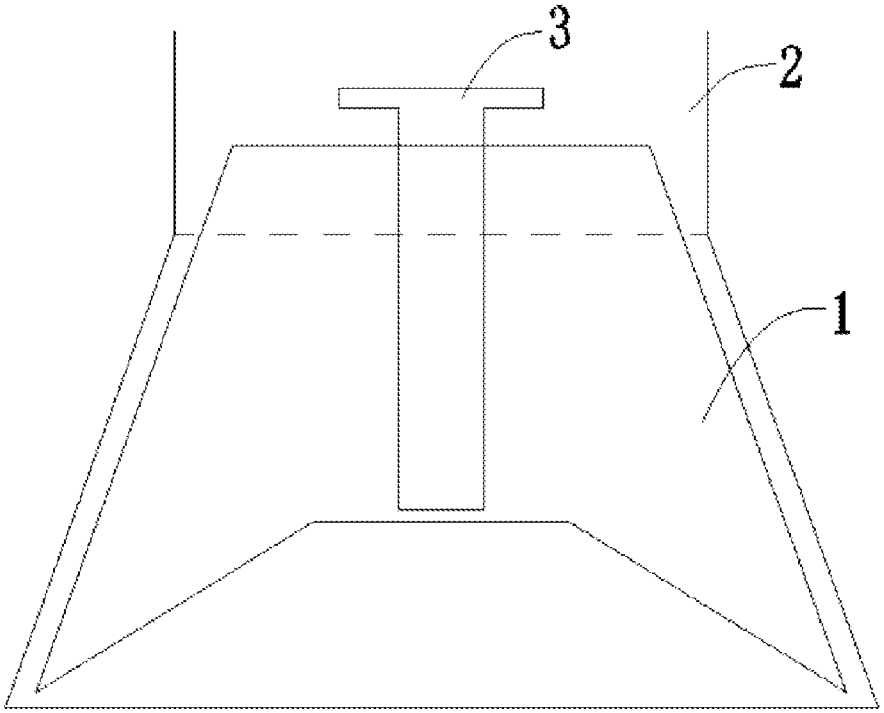
FIG. 2 is a second cross-sectional schematic diagram of the assembled structure system according to the present invention.
Figure 3:
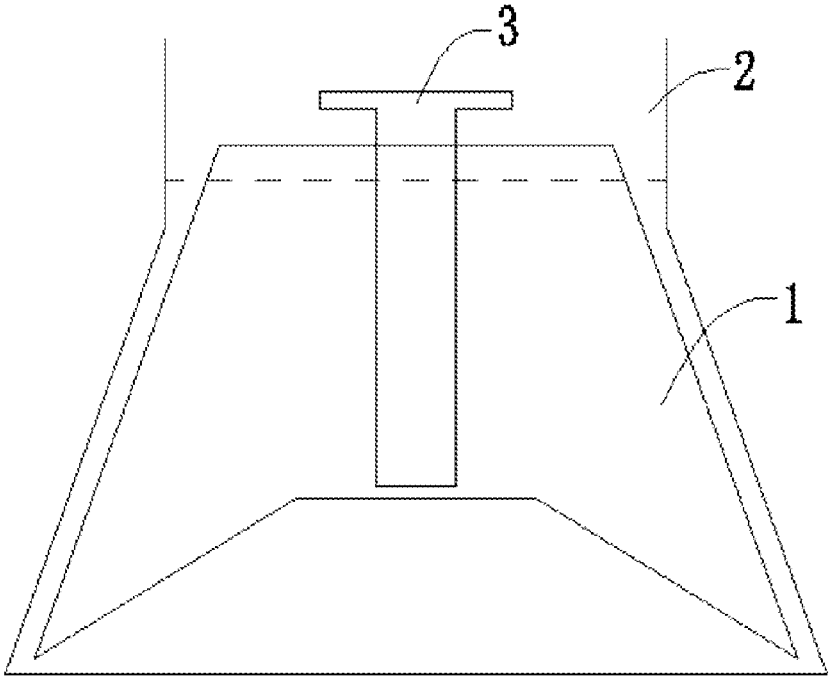
FIG. 3 is a third cross-sectional schematic diagram of the assembled structure system according to the present invention.

As shown in FIGS. 1-3, an assembled structure system of the present invention includes the cavity 2 in the prefabricated member 4, the fastener 1 and the locking member 3. The fastener 1 is mounted in the cavity 2. The cavity 2 includes the upper end surface 21, the lower end surface 22, the left end surface 23 and the right end surface 24. The upper end surface 21 is provided with the fastener through hole 213 through which the fastener 1 passes, or the locking member through hole 211 through which the locking member 3 passes. The fastener 1 is inserted into the cavity 2 from the left end or the right end of the cavity 2, or placed into the cavity 2 from the fastener through hole 213 of the upper end surface 21 of the cavity 2. The locking member 3 passes through the locking member through hole 211 or the fastener through hole 213 on the cavity 2, is locked into the locking hole 111 in the fastener 1, and presses on the bottom surface 12, so that the bottom surface 12 expands towards two sides and drives two side surfaces to expand outwardly. When a bottom corner of the fastener 1 reaches a connection portion between the inclined surface 232 and the lower end surface 22 of the cavity 2, a position in each of both side surfaces of the fastener 1 exactly abuts against a connection portion between the vertical surface 231 and the inclined surface 232 of the cavity 2, so that the fastener 1 is tightly attached to the lower end side (inclined surface 232) of the cavity 2.

Figure 4:
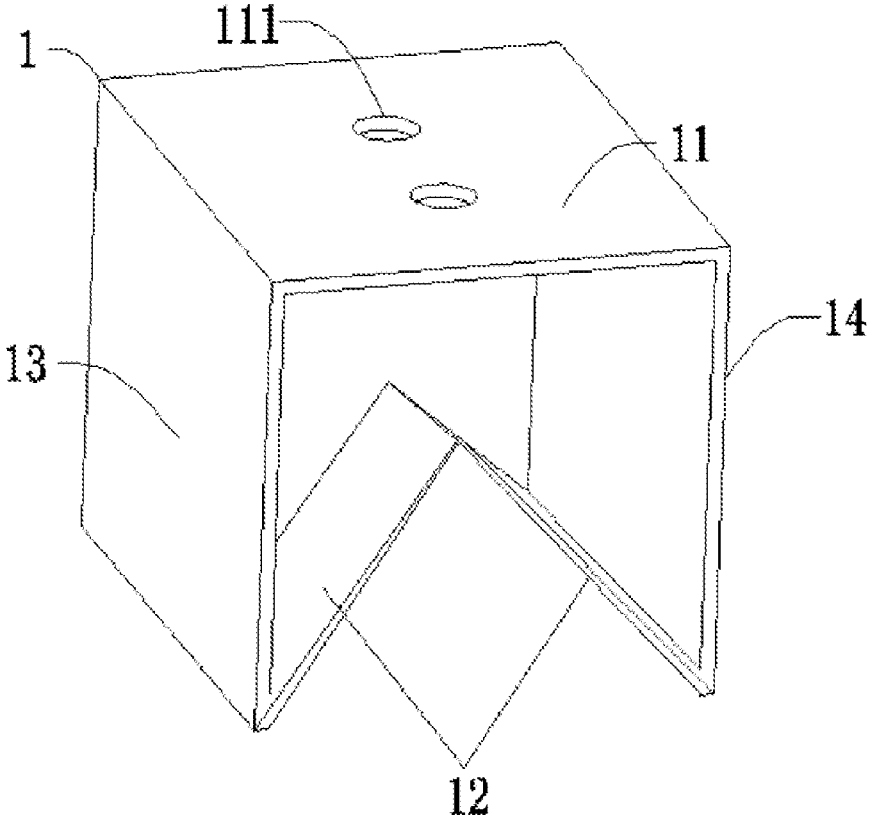
FIG. 4 is a first structural schematic diagram of a fastener according to the present invention.

As shown in FIG. 4, the fastener 1 includes the fixed surface 11, two side surfaces and the bottom surface 12. The fixed surface 11, the two side surfaces and the bottom surface 12 are hingedly connected. Optionally, there is flexibleness in connection portions between the fixed surface 11 and the two side surfaces, connection portions between the two side surfaces and the bottom surface 12, and a connection portion between the bottom surfaces. The fixed surface 11 is provided with at least one through hole or locking hole 111. The bottom surface 12 is configured as two inclined bottom surfaces, and the two inclined bottom surfaces may be separated from or connected to each other. The two inclined bottom surfaces are connected to the two side surfaces, and the total width of the two inclined bottom surfaces is greater than or equal to the width of the fixed surface 11.

Figure 5:
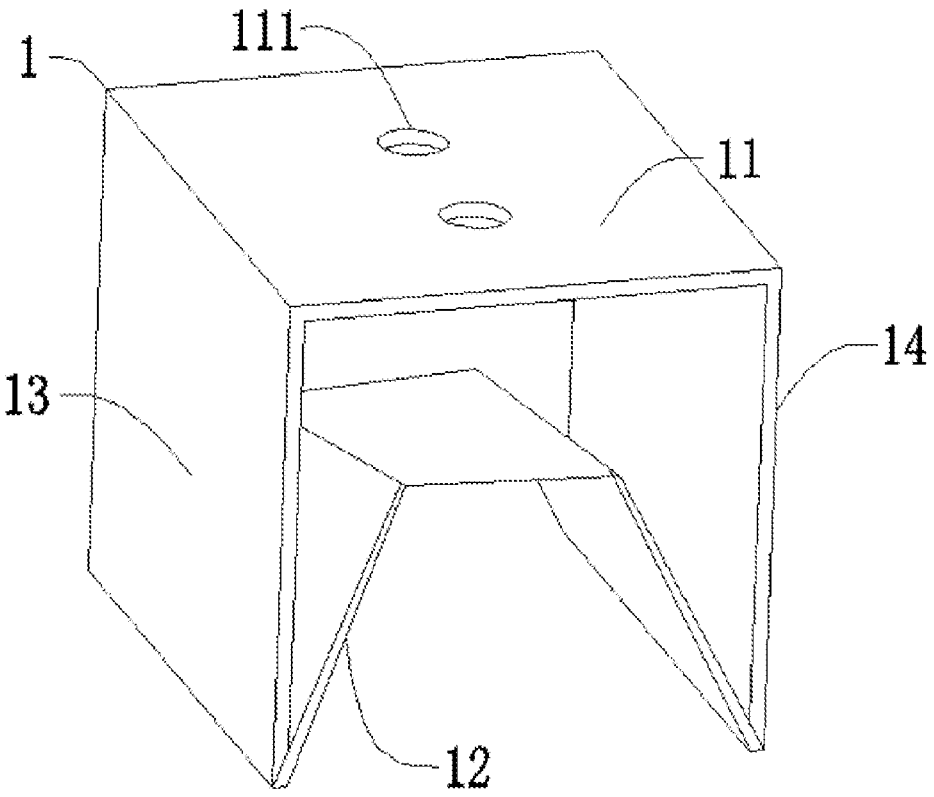
FIG. 5 is a second structural schematic diagram of the fastener according to the present invention.

As shown in FIG. 5, based upon FIG. 4, the bottom surface 12 of the fastener 1 is in a trapezoidal structure, and the total width of the trapezoidal structure is greater than or equal to the width of the fixed surface 11.

Figure 6:
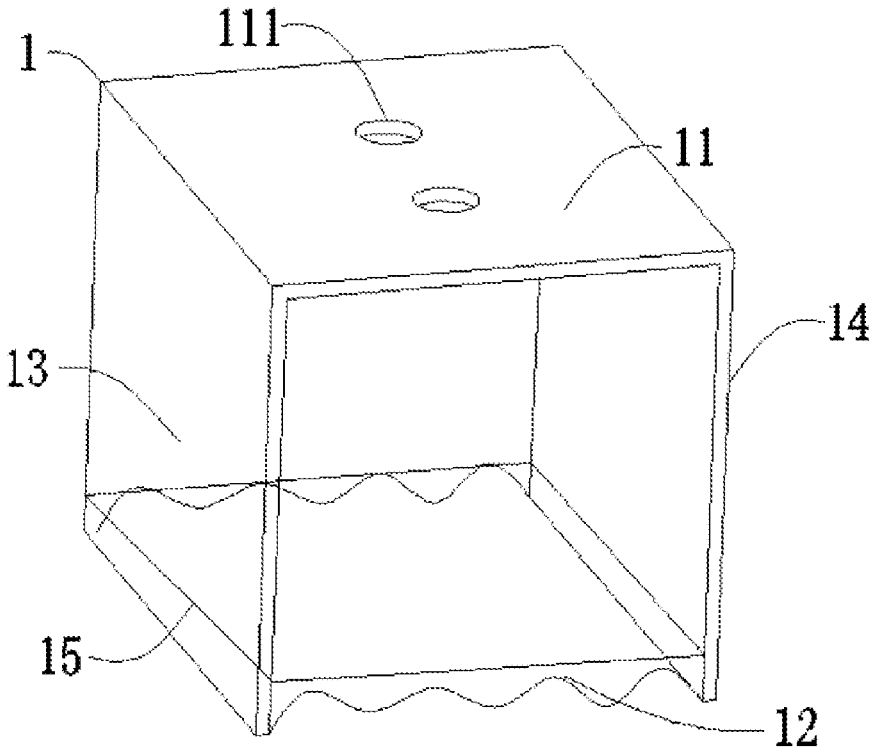
FIG. 6 is a third structural schematic diagram of the fastener according to the present invention.
Figure 7:
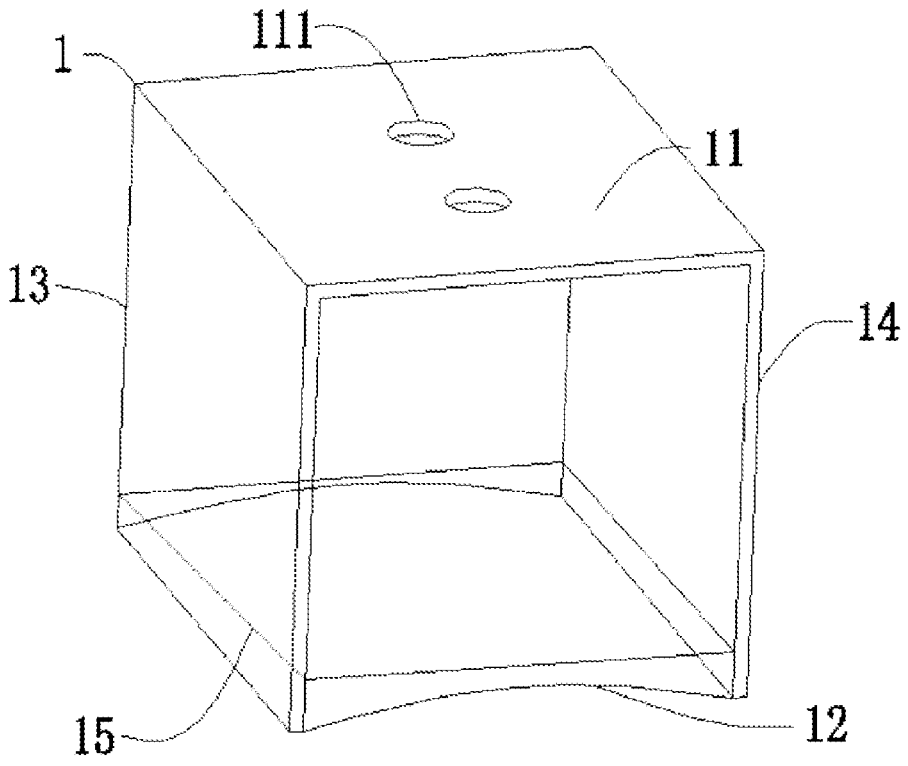
FIG. 7 is a fourth structural schematic diagram of the fastener according to the present invention.
Figure 8:
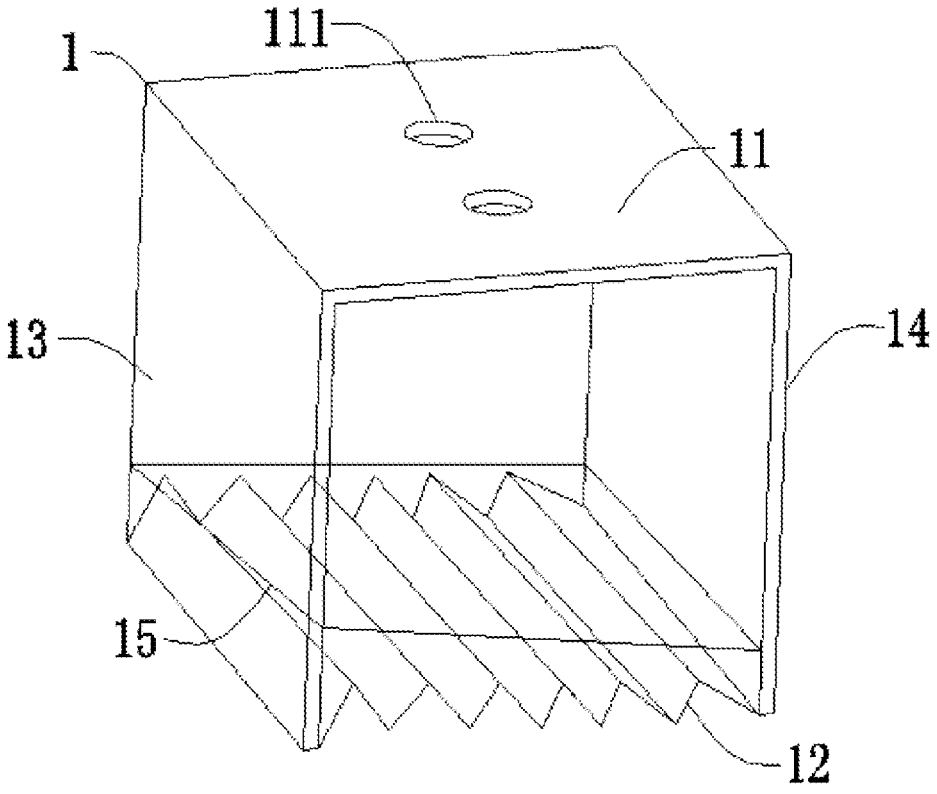
FIG. 8 is a fifth structural schematic diagram of the fastener according to the present invention.

As shown in FIGS. 6-8, based upon FIG. 4, the bottom surface 12 of the fastener 1 may be in a curved surface, an arc surface and a fold-line surface. The total width of each of the curved surface, the arc surface and the fold-line surface is greater than or equal to the width of the corresponding fixed surface 11. The block 15 is disposed on the curved surface, the arc surface and the fold-line surface, and the block 15 is configured to enable the stress on the bottom surface to be more uniform.

Figure 9:
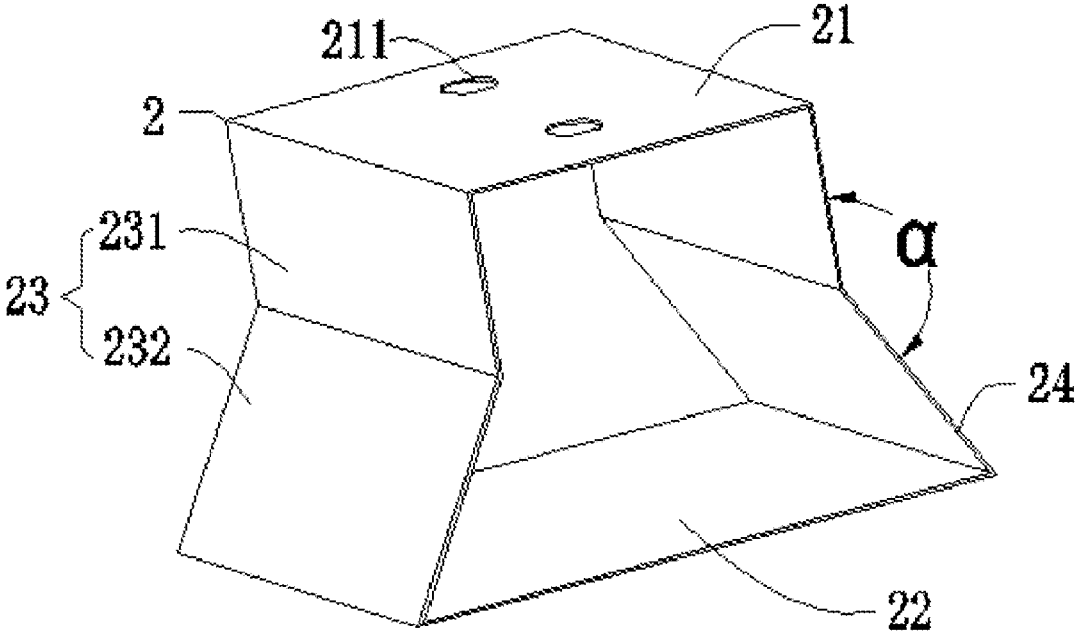
FIG. 9 is a first structural schematic diagram of a cavity according to the present invention.
Figure 10:
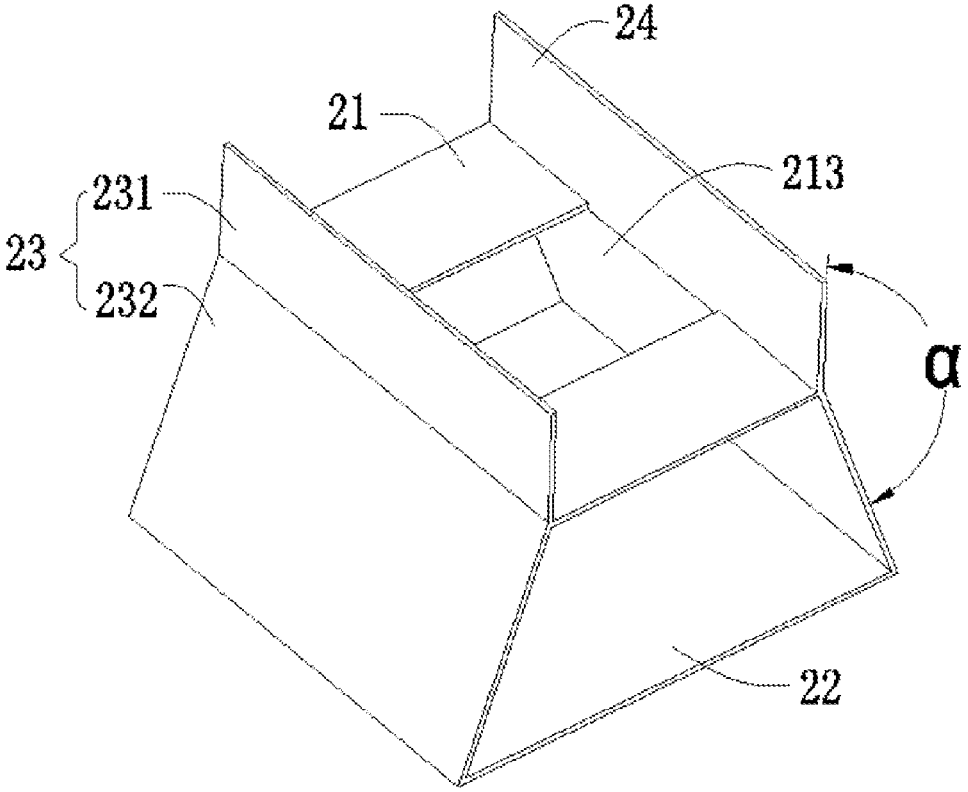
FIG. 10 is a second structural schematic diagram of the cavity according to the present invention.
Figure 11:
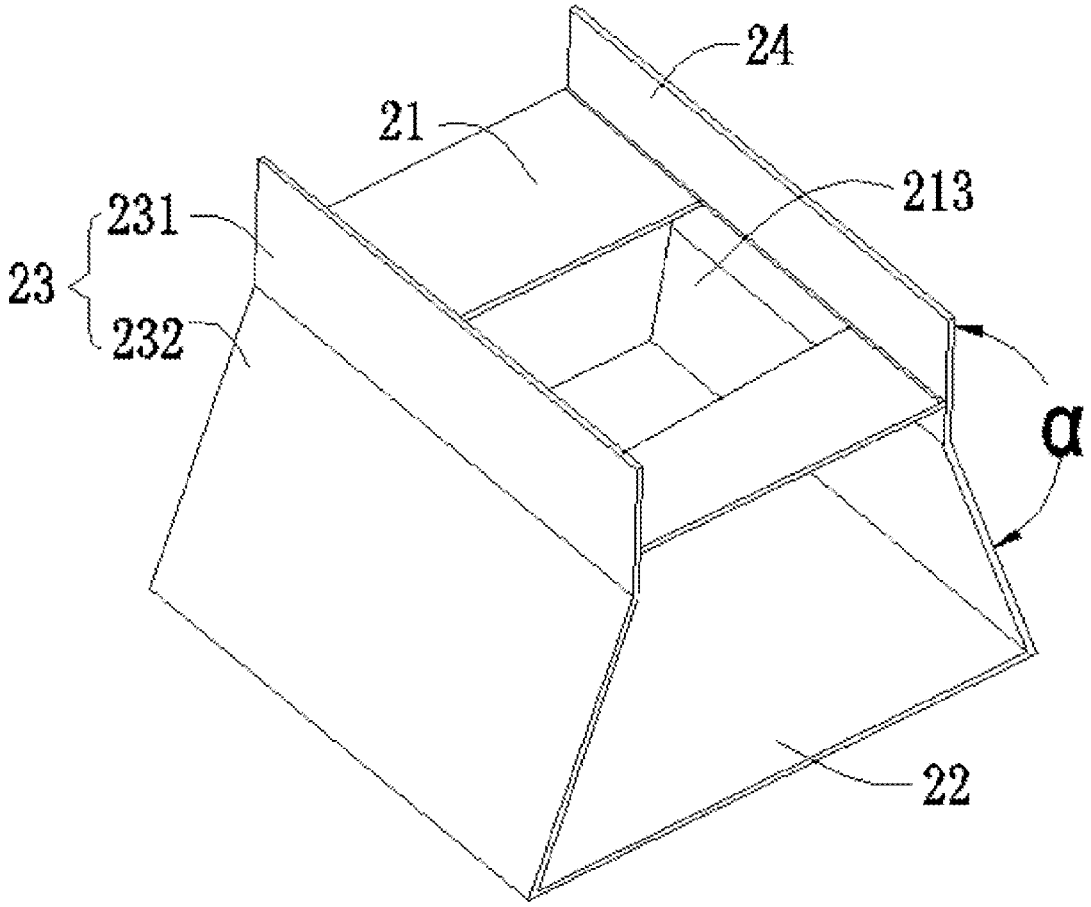
FIG. 11 is a third structural schematic diagram of the cavity according to the present invention.

As shown in FIGS. 9-11, the cavity 2 includes the upper end surface 21, the lower end surface 22, the left end surface 23 and the right end surface 24. The left end surface 23 and the right end surface 24 are symmetrical to each other. Each of the left end surface 23 and the right end surface 24 includes the vertical surface 231 perpendicularly connected to the upper end surface 21, and the inclined surface 232 connected to the vertical surface 231. A connection angle between the vertical surface 231 and the outer side of the inclined surface 232 forms an obtuse angle α, and preferably, a is 120°-175°. The inclined surface 232 of each of the left end surface 23 and the right end surface 24 is connected to the lower end surface 22. The upper end surface 21 is connected to the vertical surface 231 of each of the left end surface 23 and the right end surface 24. The upper end surface 21 is located at the upper end or the lower end of the vertical surface 231, or located between the upper end and the lower end of the vertical surface 231. When the height of the upper end surface 21 is higher than the fastener 1, the upper end surface 21 may be provided with the locking member through hole 211 or the fastener through hole 213. When the height of the upper end surface 21 is lower than the fastener 1, the upper end surface 21 is provided with the fastener through hole 213, through which the fastener 1 passes.

The assembled structure system of the present invention can be applied on the profile 5 or constructions of buildings and appendages thereof. The profile 5 includes applications in furniture, industrial frameworks and the like. The constructions of the buildings and appendages thereof include columns, beams, shear walls, external wall panels, internal wall panels, floor slabs, stairs, balcony slabs, bridges and bridge piers. The applications in the furniture include cabinets, wardrobes, bookcases, lockers, guardrails, tables, chairs, doors, windows and the like. The profile 5 is preferably an aluminum alloy profile.

Figure 12:
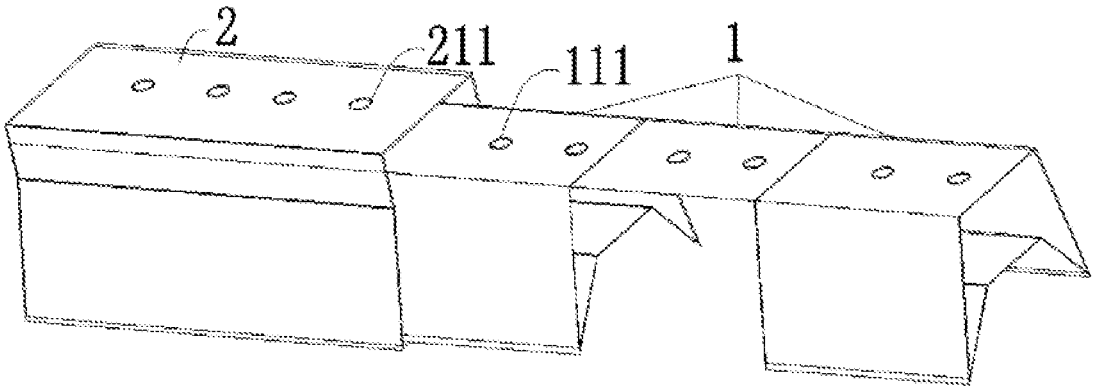
FIG. 12 is a schematic diagram of an assembling application of the assembled structure system according to the present invention.

As shown in FIG. 12, the fastener 1 can be application of a plurality of integrated fasteners that are staggered and connected in the cavity 2. A connected fixed surface at a staggered portion of the fastener 1 is further provided with at least one through hole or threaded hole through which a bolt passes and a matching bolt, and is connected to the lower end surface 22 of the cavity 2 for reinforcement.

Figure 13:
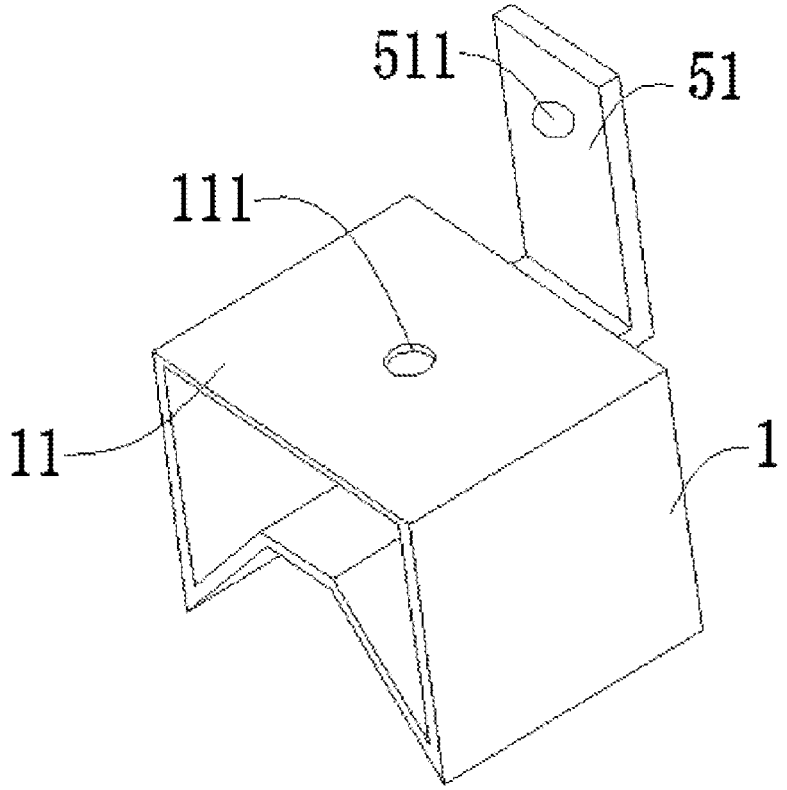
FIG. 13 is a schematic diagram of connection and fitting of the fastener according to the present invention.

As shown in FIG. 13, the fixed member 51 is further disposed at the lower end of the fixed surface 11 of the fastener 1, and the fixed member 51 is an angle connector. Both ends of the angle connector are provided with at least one threaded hole 511, and the threaded hole 511 is located under and corresponds to the locking hole or through hole 111. The angle connector preferably defines a right angle, and the connector formed by the fastener 1 and the fixed member 51 is configured to perform the assembling connection of various angles of the members, profiles or other fittings, as desirable.

Figure 14:
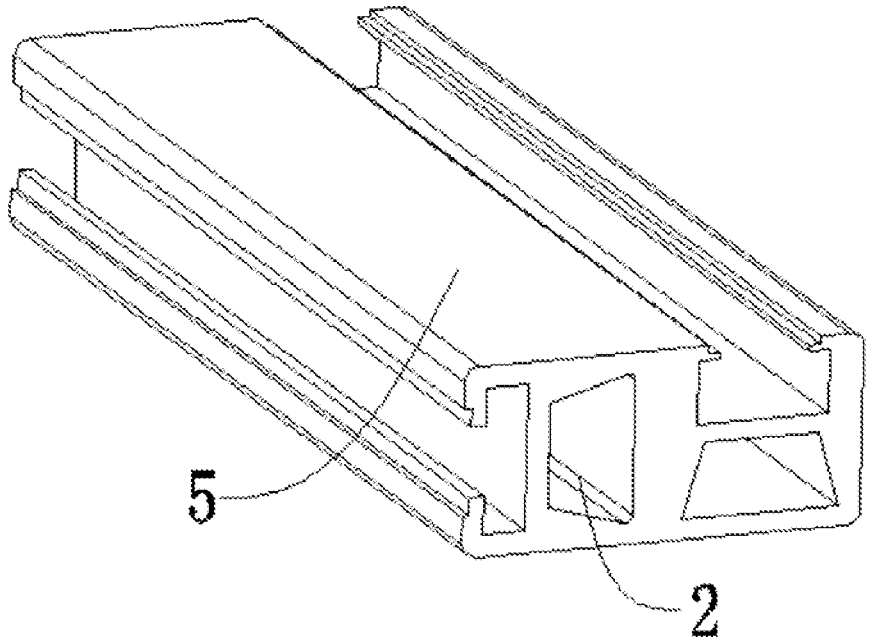
FIG. 14 is a first schematic diagram of an application of the cavity on a profile according to the present invention.
Figure 15:
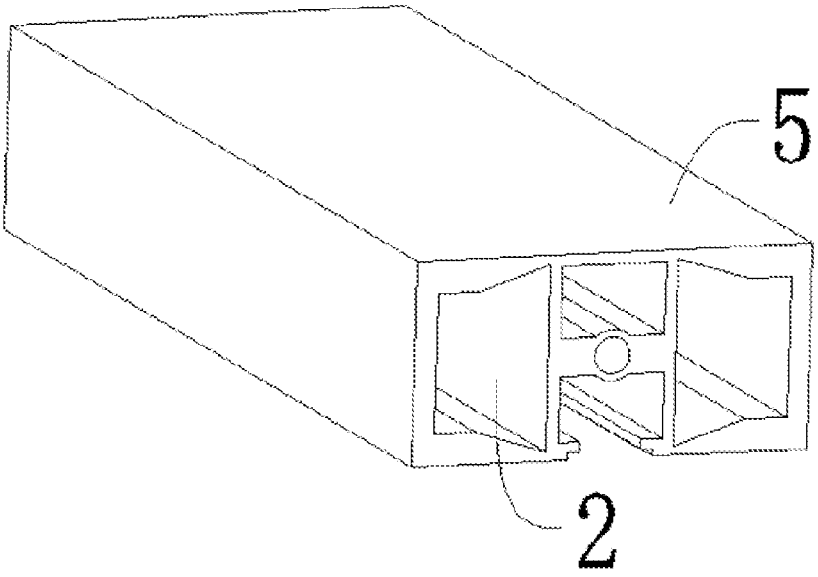
FIG. 15 is a second schematic diagram of the application of the cavity on the profile according to the present invention.
Figure 16:
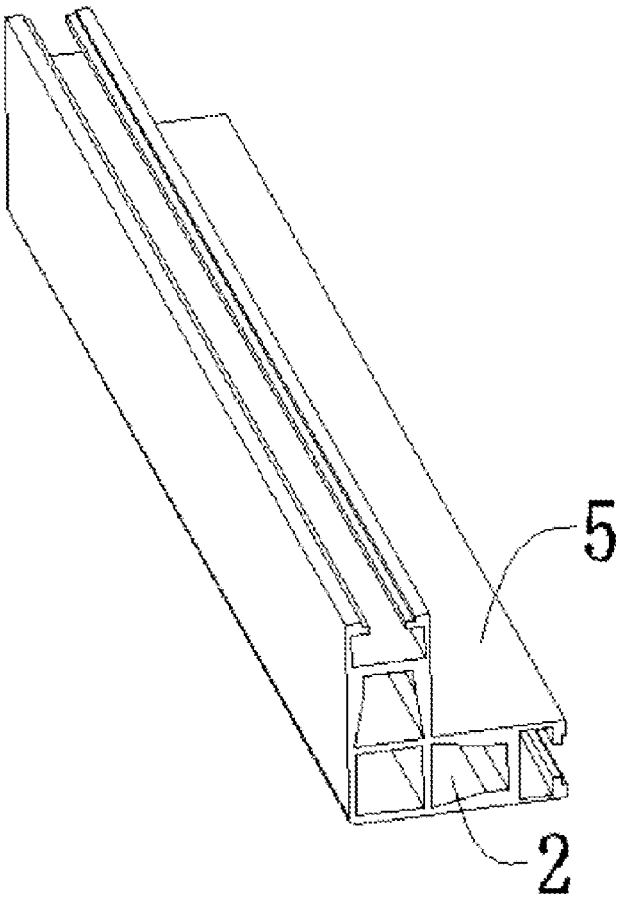
FIG. 16 is a third schematic diagram of the application of the cavity on the profile according to the present invention.
Figure 17:
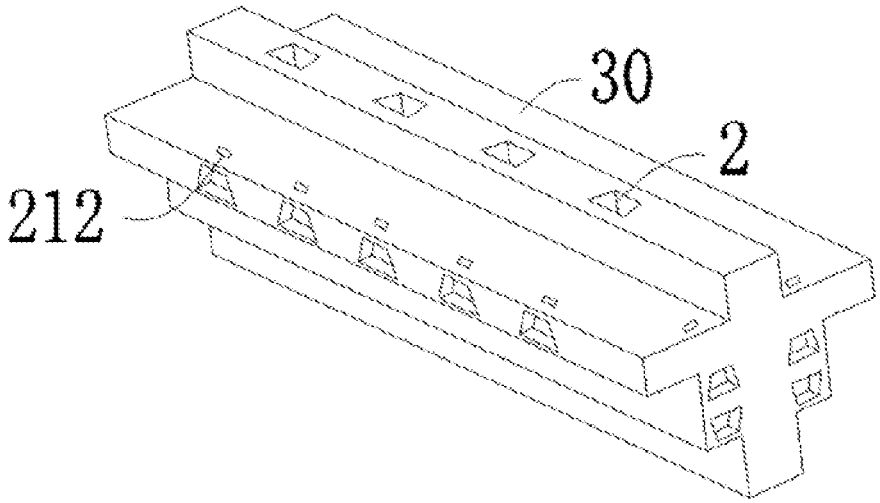
FIG. 17 is a structural schematic diagram of a wing-shaped beam with the cavity according to the present invention.
Figure 18:
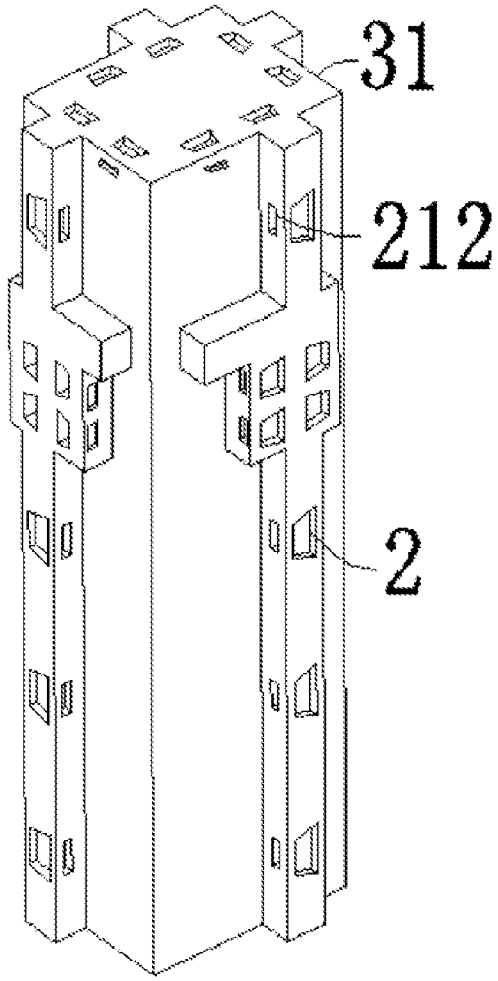
FIG. 18 is a structural schematic diagram of a wing-shaped column with the cavity according to the present invention.
Figure 19:
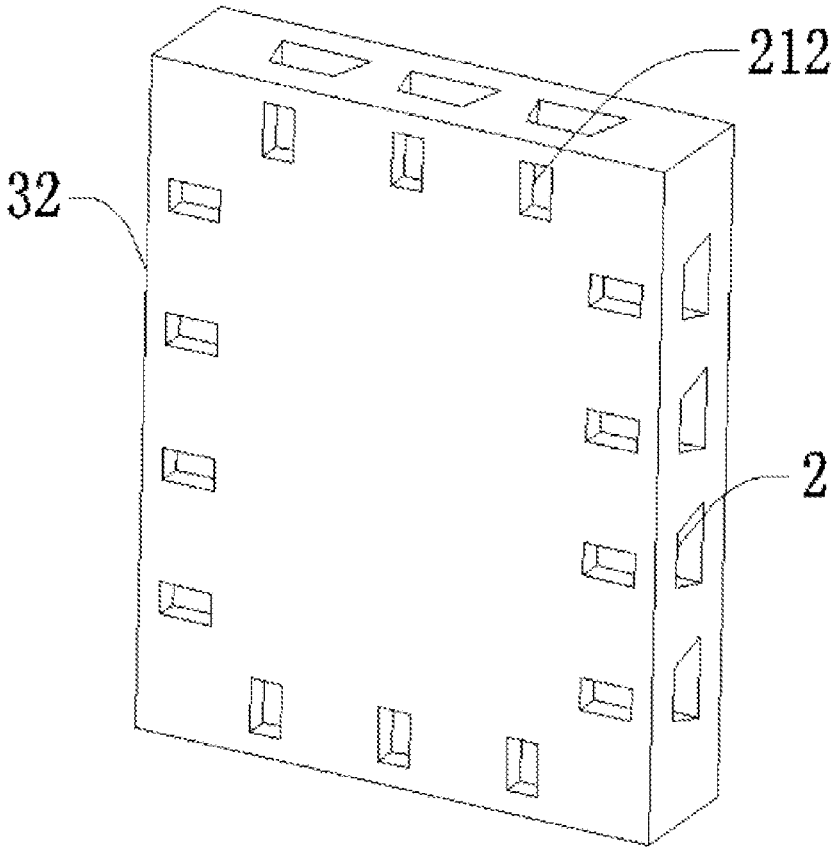
FIG. 19 is a structural schematic diagram of a wall with the cavity according to the present invention.
Figure 20:
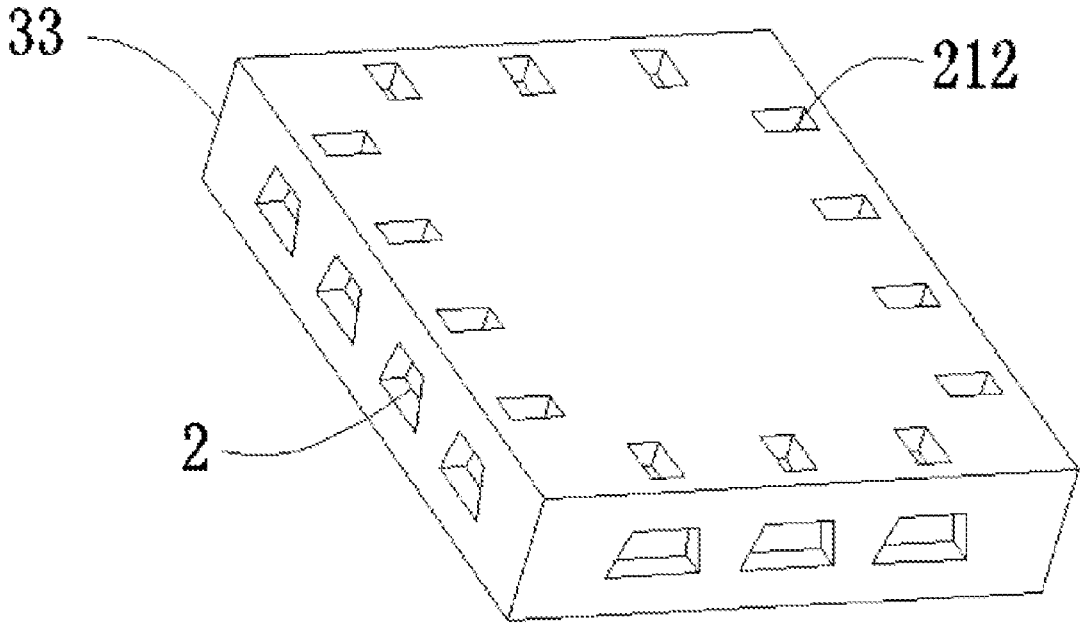
FIG. 20 is a structural schematic diagram of a floor slab with the cavity according to the present invention.

As shown in FIGS. 14-16, the profile 5 is provided with the cavity 2. The profile 5 is preferably an aluminum alloy profile, and is used as a structure in the furniture or industries for transversely or longitudinally assembling a corresponding framework.

As shown in FIGS. 17-20, the prefabricated member 4 is the wing-shaped beam 30, the wing-shaped column 31, the prefabricated wall 32, the prefabricated floor slab 33 and a stair. A channel steel or a channel steel framework is disposed on the prefabricated member 4. The cavity 2 is located in the channel steel or connected to the channel steel framework. The locking member mounting preformed hole or fastener mounting preformed hole 212 is disposed at the outer side of the cavity 2 of the prefabricated member 4.

Figure 21:
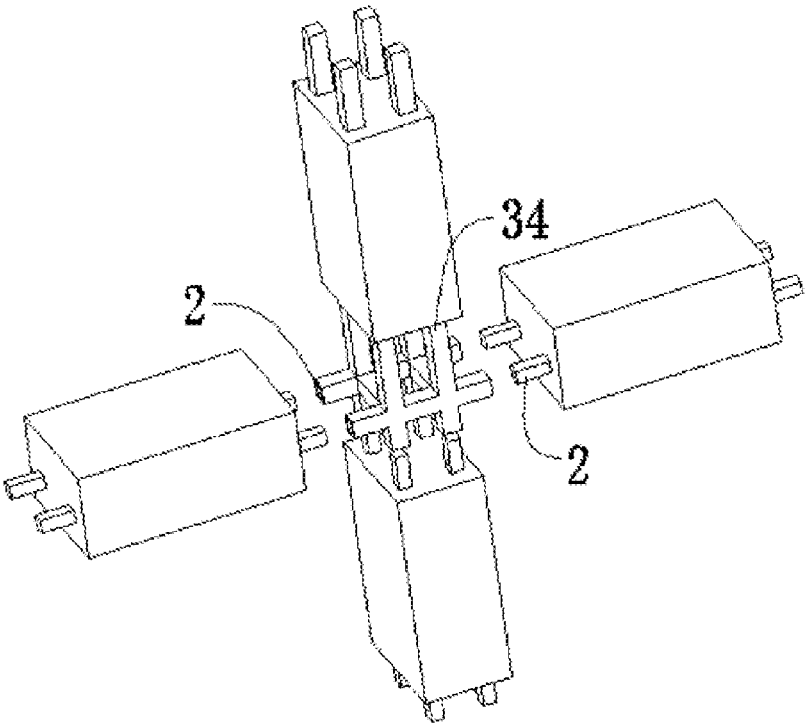
FIG. 21 is a schematic diagram of assembly of an in-situ casting beam-column joint.

FIG. 21 shows an in-situ casting beam-column joint 34. The prefabricated member 4 is a laminated beam, a column, a shear wall, an external wall panel, an internal wall panel, a laminated floor slab, a balcony slab, a stair and others that are prefabricated by channel steel reinforced concrete. The assembled structure system of the present invention is employed for assembly and then the floor slab layer is casted in situ to make the building more firm.

Figure 22:
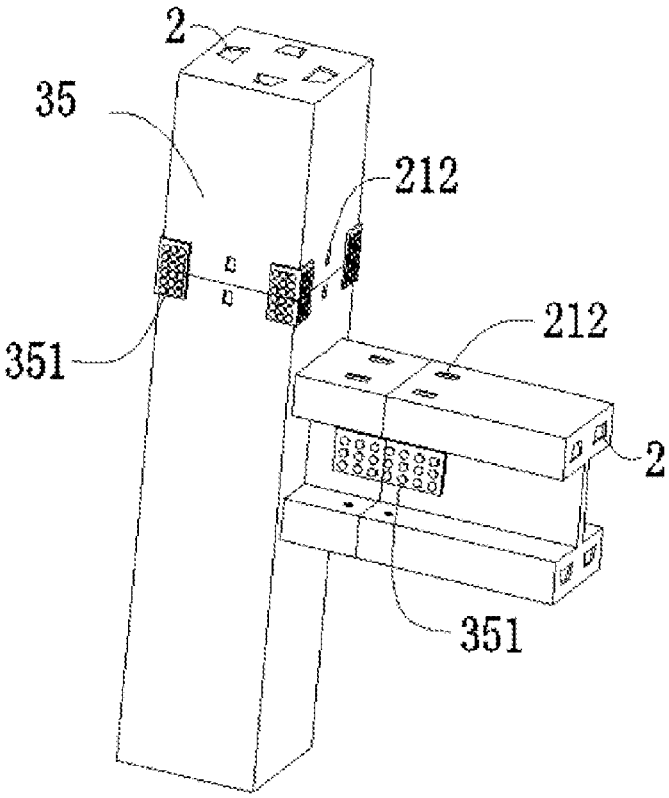
FIG. 22 is a schematic diagram of connection of a steel structure framework with a built-in cavity configuration according to the present invention.

FIG. 22 shows the steel framework structure 35 that is transversely or longitudinally assembled by taking the profile 5, channel steel or channel steel framework with the built-in cavity configuration 2 as the structure according to the present invention. The cavity configuration at the assembling end is provided with the mounting preformed hole 212. The profile 5, the channel steel or the channel steel framework is preferably a steel material or an aluminum alloy. The steel plate 351 and the bolt can be used for reinforcing or welded reinforcing the assembling connection portion after the assembling is completed using the assembled structure system of the present invention.

When the assembled structure system of the present invention is used for assembled buildings, the prefabricated member 4 with the cavity 2 is used for assembling connection with the fastener 1, and such an assembling manner has higher accuracy, faster speed and higher assembling efficiency. Grout filling can be further performed at the assembled connection portion after the assembling to strengthen the assembling. The fastener is a hinged surrounding body to improve the anti-seismic performance of the building. Since the fasteners are directly connected inside the prefabricated member and can be pre-placed in the cavity of the prefabricated member, the assembling and splicing can be performed by reserving a relatively small space for the connected members, and the construction and the decoration can be integrated for full assembly. In addition, the channel steel or the channel steel framework in the prefabricated member and the reinforced concrete can be integrally combined to bear the force together to make the entire building more firm. Moreover, the channel steel or the channel steel framework can directly build a formwork support to make the fabricating or in-situ casting working of the prefabricated member easier and more convenient, and also facilitate the manufacturing of irregular or special members.

In conclusion, as for the assembled structure system of the present invention, the assembly is easy, convenient, fast and firm, has high accuracy and improves the anti-seismic performance.

The above only describes the preferred embodiments of the present invention, but the scope of protection of the present invention is not limited thereto. Changes or replacements that may be easily envisaged by those skilled in the art within the technical scope disclosed by the present invention shall fall within the scope of protection of the present invention.

What is claimed is:

1. An assembled structure system, comprising a prefabricated member, at least one fastener, and a locking member, wherein the prefabricated member is provided with at least one cavity;

the at least one fastener is assembled in each cavity of the at least one cavity;

the each cavity comprises an upper end surface, a lower end surface, a left end surface, and a right end surface; wherein the upper end surface is provided with a fastener through hole or a locking member through hole, wherein the at least one fastener passes through the fastener through hole, and the locking member passes through the locking member through hole;

each of the left end surface and the right end surface comprises a vertical surface and an inclined surface, wherein the vertical surface is perpendicularly connected to the upper end surface and the inclined surface is connected to the vertical surface; wherein a connection angle between the vertical surface and an outer side of the inclined surface forms an obtuse angle;

the inclined surface of each of the left end surface and the right end surface is connected to the lower end surface;

the upper end surface is located at an upper end or a lower end of the vertical surface, or located between the upper end and the lower end of the vertical surface; and the at least one fastener comprises a fixed surface, two side surfaces, and a bottom surface; wherein the fixed surface is provided with at least one locking hole or at least one through hole;

the bottom surface is a curved surface, an arc surface, a fold-line surface, or a trapezoidal surface;

a total width of the bottom surface is greater than or equal to a width of the fixed surface, and the total width of the bottom surface is greater than or equal to a width of the lower end surface;

the bottom surface is formed by two inclined bottom surfaces, wherein the two inclined bottom surfaces are folded inwardly;

a total width of the two inclined bottom surfaces is greater than or equal to the width of the fixed surface, and the total width of the two inclined bottom surfaces is greater than or equal to the width of the lower end surface;

a height of the at least one fastener is higher than a height of the inclined surface;

the at least one fastener has a flexibleness in connection portions between the fixed surface and the two side surfaces, and connection portions between the two side surfaces and the bottom surface;

the fixed surface and the two side surfaces are hingedly connected, and the two side surfaces and the bottom surface are hingedly connected.

2. The assembled structure system of claim 1, wherein the connection angle between the vertical surface and the outer side of the inclined surface is 120°-175°.

3. The assembled structure system of claim 1, wherein a block is disposed above the bottom surface.

4. The assembled structure system of claim 1, wherein a fixed member is disposed under the fixed surface, and the fixed member is provided with at least one threaded hole; and the at least one threaded hole is located under and corresponds to the at least one locking hole or the at least one through hole.

5. The assembled structure system of claim 4, wherein the fixed member is an angle connector, and each of both end surfaces of the angle connector is provided with the at least one threaded hole.

6. The assembled structure system of claim 1, wherein the locking member is a bolt or a screw.

7. The assembled structure system of claim 1, wherein the left end surface and the right end surface are symmetrical to each other, and the two side surfaces of the at least one fastener are symmetrical to each other.

8. The assembled structure system of claim 1, wherein the two inclined bottom surfaces are separated from or connected to each other.

9. A method for using the assembled structure system of claim 1, comprising: applying the assembled structure system to a profile.

10. The method of claim 9, wherein the profile is applied to a furniture or industrial frameworks.

11. The method of claim 10, wherein the furniture comprises a cabinet, a wardrobe, a bookcase, a locker, a clapboard, a guardrail, a table, a chair, a door, or a window.

12. The method of claim 9, wherein the connection angle between the vertical surface and the outer side of the inclined surface is 120°-175°.

13. The method of claim 9, wherein a block is disposed above the bottom surface.

14. The method of claim 9, wherein a fixed member is disposed under the fixed surface, and the fixed member is provided with at least one threaded hole; and the at least one threaded hole is located under and corresponds to the at least one locking hole or the at least one through hole.

15. The method of claim 14, wherein the fixed member is an angle connector, and each of both end surfaces of the angle connector is provided with the at least one threaded hole.

16. A method for using the assembled structure system of claim 1, comprising: applying the assembled structure system to a building or an appendage construction of the building.

17. The method of claim 16, wherein the building or the appendage construction of the building comprises a column, a beam, a shear wall, an external wall panel, an internal wall panel, a floor slab, a stair, a balcony slab, a bridge, or a bridge pier.

18. The method of claim 17, wherein the column is a wing-shaped column, and the beam is a wing-shaped beam.

19. The method of claim 16, wherein a channel steel or a channel steel framework is disposed in the prefabricated member; the at least one cavity is located in the channel steel, or the at least one cavity is connected to the channel steel framework.

20. The method of claim 16, wherein a locking member mounting preformed hole or a fastener mounting preformed hole is disposed at an outer side of the at least one cavity of the prefabricated member.

* * * * *